US005182989A

United States Patent [19]

D'Heureuse et al.

[11] Patent Number: 5,182,989

[45] Date of Patent: Feb. 2, 1993

[54] SEALING DEVICE

[75] Inventors: Walter D'Heureuse, Ladenburg; Martin Greive, Leimen; Gerhard Heppenstiel, Bammental; Hans-Jürgen Kusch, Neckargemünd, all of Fed. Rep. of Germany

[73] Assignee: Heidelberg Druckmaschinen AG, Heidelberg, Fed. Rep. of Germany

[21] Appl. No.: 826,646

[22] Filed: Jan. 22, 1992

Related U.S. Application Data

[63] Continuation of Ser. No. 518,548, May 3, 1990, abandoned.

[30] Foreign Application Priority Data

May 3, 1989 [DE] Fed. Rep. of Germany ..... 3914648

[51] Int. Cl.[5] ..... B41L 23/00

[52] U.S. Cl. ..... 101/148; 101/363

[58] Field of Search ..... 101/132.5, 147, 148, 101/207, 323, 350, 363, 210, 364

[56] References Cited

U.S. PATENT DOCUMENTS

| | | | |
|---|---|---|---|
| 2,301,535 | 11/1942 | Green | 101/210 |
| 2,922,364 | 1/1960 | Nitchie et al. | 101/364 |
| 3,032,007 | 5/1962 | McCauliff | 101/210 |
| 3,566,787 | 3/1971 | Moos | 101/350 |
| 3,769,909 | 11/1973 | Fugman et al. | 101/148 |
| 3,805,700 | 4/1974 | Chambon | 101/148 |
| 4,165,688 | 8/1979 | Leanna et al. | 101/210 |
| 4,181,076 | 1/1980 | Gattus | 101/350 |
| 4,361,089 | 11/1982 | Wittkopf | 101/210 |
| 4,414,900 | 11/1983 | Kraus et al. | 101/364 |
| 4,419,932 | 12/1983 | Cappel | 101/210 |
| 4,982,660 | 1/1991 | Hamm et al. | 101/350 |
| 4,991,504 | 2/1991 | Fina | 101/363 |

FOREIGN PATENT DOCUMENTS

| | | |
|---|---|---|
| 0047350 | 12/1984 | European Pat. Off. . |
| 0296394 | 12/1988 | European Pat. Off. . |

*Primary Examiner*—Edgar S. Burr
*Assistant Examiner*—J. R. Keating
*Attorney, Agent, or Firm*—Herbert L. Lerner; Laurence A. Greenberg

[57] ABSTRACT

A sealing device for a dampening unit on an offset printing press having a channel for receiving a dampening-solution supply and defined by a dampening-solution applicator roller and a metering roller which roll on one another, and having a seal holder mountable on a side part of the dampening unit and being in contact engagement with a sealing element, closing off one end of the channel, the sealing element having formed with an overflow opening for excess dampening solution, comprising a drain passage located between the sealing element and the seal holder and formed by a cutout on a side of the sealing element facing away from the channel, the cutout being connected with the overflow opening.

6 Claims, 3 Drawing Sheets

SEALING DEVICE

This application is a continuation of application Ser. No. 518,548, filed May 3, 1990, now abandoned.

The invention relates to a sealing device for a dampening unit of an offset printing press, and more particularly, having a channel for receiving a dampening-solution supply and defined by an applicator roller and a metering roller, which roll on one another. The sealing device includes a seal holder mountable on a side part of the dampening unit, and a sealing element in contact engagement with the seal holder and closing off one end of the channel. Furthermore, the sealing element is formed with an overflow opening for excess dampening solution.

Such a sealing device has become known heretofore, for example, from German Published Non-Prosecuted Application (DE-OS) 22 06 498. In this heretofore known sealing device, the sealing element is formed of elastic sealing material and includes, furthermore, a baffle plate on which the elastic sealing material is guided. The baffle plate is penetrated by a tube projecting into the channel, then bent upwardly and forming a horizontal opening. If the dampening solution in the channel reaches the filling level corresponding to the level of the tube opening, excess dampening solution drains off through the tube. The tube, furthermore, extends through the seal holder in order then to return the dampening solution to the dampening-solution supply by means of a line.

With regard to its construction, this heretofore known device is considered to be comparatively costly. In addition, this heretofore known sealing device also has disadvantages with regard to assembly and utilization technology. The overflow tube, which passes through the baffle plate, is a hindrance when the sealing element, which represents a part subject to wear, is being replaced; this applies as well when the sealing device is being assembled.

With regard to the afore-described prior art, it is an object of the invention to provide an improved sealing device which is especially advantageous with regard to installation and utilization.

With the foregoing and other objects in view, there is provided, in accordance with the invention, a sealing device for a dampening unit on an offset printing press having a channel for receiving a dampening-solution supply and defined by a dampening-solution applicator roller and a metering roller which roll on one another, and having a seal holder mountable on a side part of the dampening unit and being in contact engagement with a sealing element, closing off one end of the channel, the sealing element having formed with an overflow opening for excess dampening solution, comprising a drain passage located between the sealing element and the seal holder and formed by a cutout on a side of the sealing element facing away from the channel, the cutout being connected with the overflow opening.

In accordance with another feature of the invention, the drain passage extends above the overflow opening so as to permit equalization of air.

In accordance with a further feature of the invention, there is provided a further roller rolling on the metering roller and disposed on side of the metering roller facing away from the dampening-solution applicator roller.

In accordance with an added feature of the invention, the further roller is a drawing roller, dipping into a dampening-solution supply container.

In accordance with an additional feature of the invention, there is provided a scanning strap disposed on a side part of the dampening unit for lapping over the seal holder when the latter is in installed condition.

In accordance with a concomitant feature of the invention, there is provided a handle portion formed on the seal holder, the handle portion partly covering the securing strap.

According to the invention, there is provided a cutout connected to the overflow opening and formed on a side of the sealing element facing away from the channel. The cutout, together with the seal holder, forms a drain passage for excess dampening solution located between the sealing element and the seal holder. The drain passage usually also forms a return to a dampening-solution supply container. The seal holder has a double function. It not only holds the sealing element but also partially forms the drain or return passage or duct. A usually provided contact pressure applied by the sealing element against the end face of one of the two rollers, usually the dampening-solution applicator roller, also readily results in the required leak-tight installation of the drain passage between the seal holder and the sealing element.

In a further embodiment of the invention, a cutout formed in a rear side of the sealing element also continues or extends above the overflow opening referring to the as-installed condition. This permits the equalization of air. A free opening in the cutout in the sealing element results in a connection of the drain passage to the surroundings i.e. atmosphere. Even in the case of a possible excess of dampening solution, with the liquid level of the dampening solution in the channel rising above the overflow opening, it is still readily possible for the dampening solution to continue to drain. It is not possible for a vacuum to form in the drain passage above the overflow opening, a vacuum which would otherwise possibly completely obstruct the drainage of the dampening solution.

A dampening-solution supply container disposed below the rollers can extend into the area of the channel. This makes it possible to return the dampening solution to the supply container without any need for any special line. In particular, it is not necessary for the drain passage, which is formed between the sealing element and the seal holder, to be connected to a further line length. Laterally, it is possible for the dampening-solution supply container to extend appropriately under the drain passage.

A further measure, also of independent significance, provides that the metering roller be assigned a further roller which rolls on the metering roller. This further roller is disposed on the side of the metering roller facing away from the dampening-solution applicator roller. Insofar as the metering roller itself operates as a drawing roller, the further roller provides an advantageous protection against splashing or splattering. Even if the metering roller is rotating at high speed, any radially splashing or splattering dampening solution is captured by the further roller. In addition, the metering of the dampening-solution excess, which is conveyed into the channel, can be adjusted in a relatively simple manner by means of the contact pressure between the further roller and the metering roller.

It is provided within the scope of the invention that the further roller be in the form of a drawing roller, which dips into the dampening-solution supply container. The further roller draws up the dampening solution, which is transferred to the metering roller by means of the rolling contact; the metering roller conveys an excess of the dampening solution into the channel between the rollers.

With regard to the seal holder, provision may also be made for a securing strap disposed on a side part of the dampening unit for lapping over the seal holder when the latter is in the installed state. By simply removing or turning away the securing strap, respectively, the seal holder is made accessible, for example if it needs to be taken out in the course of maintenance work. The seal holder may be provided with a handle portion which partly covers the securing strap.

Other features which are considered as characteristic for the invention are set forth in the appended claims.

Although the invention is illustrated and described herein as embodied in a sealing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
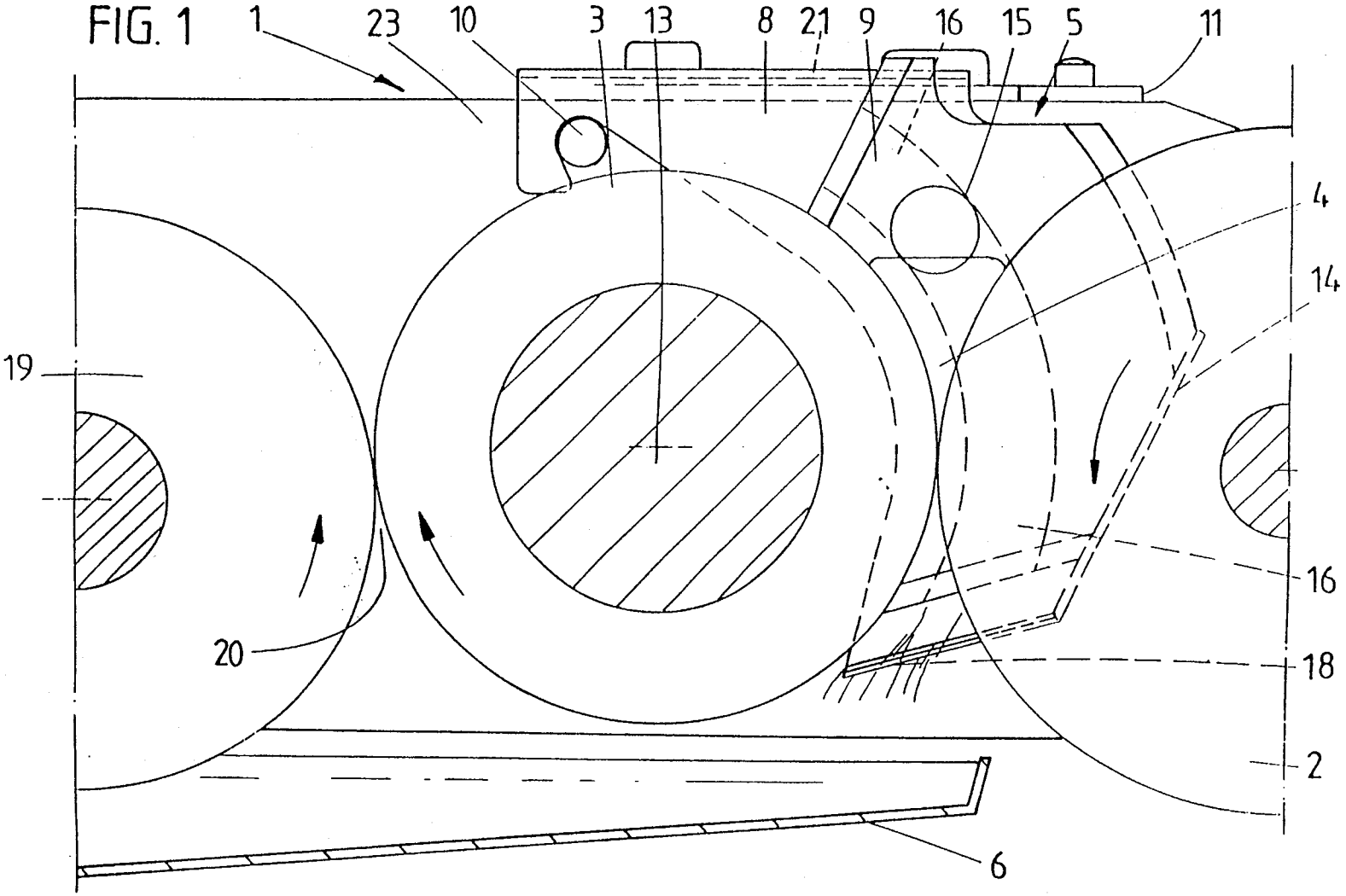
FIG. 1 is a front elevational view, partly in section, of a dampening unit with a sealing device constructed in accordance with the invention.
Figure 2:
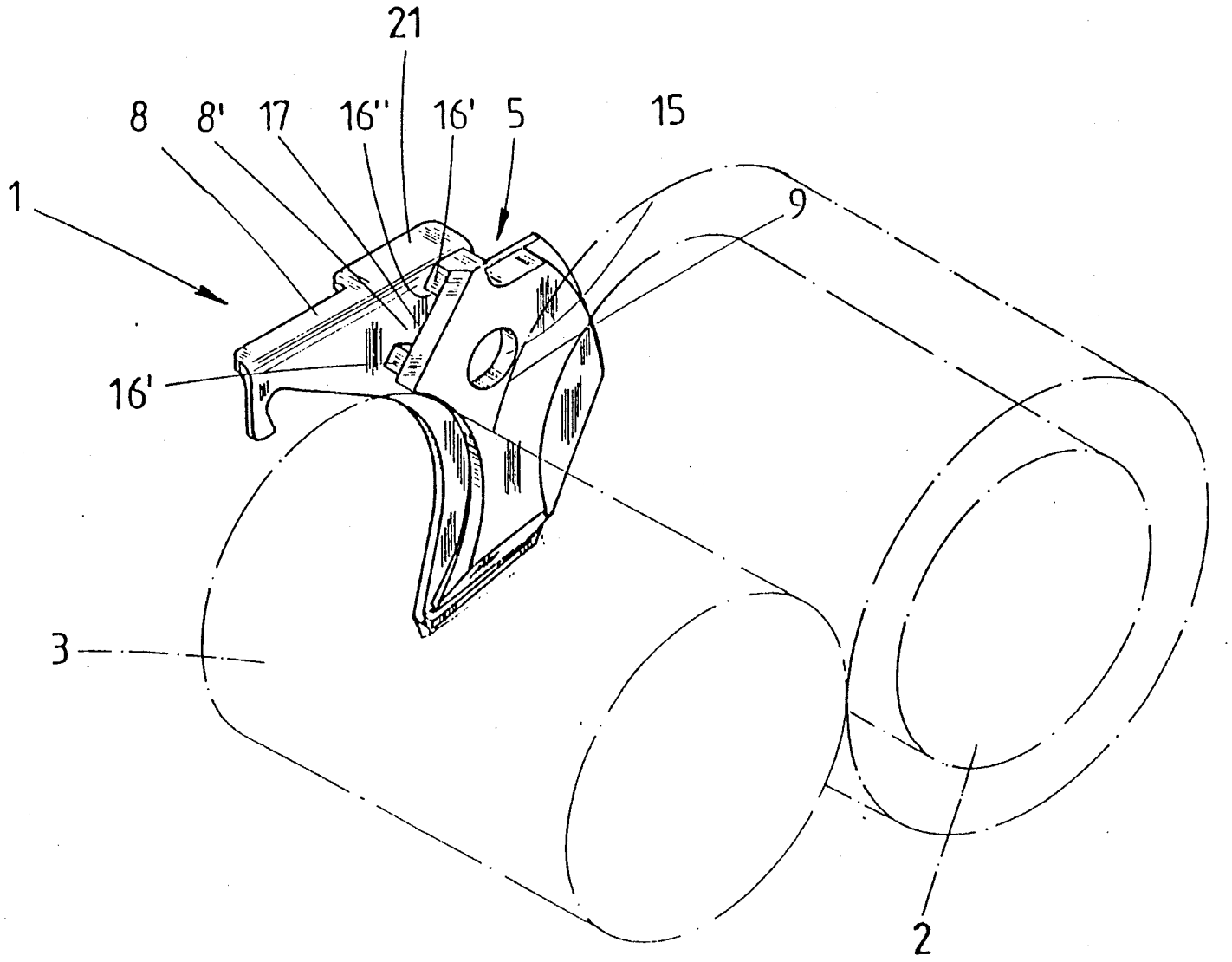
FIG. 2 is a perspective view of the sealing device with rollers of the dampening unit indicated in phantom.

Referring now to the drawing and first, particularly, to FIG. 1 thereof, there is shown a dampening unit 1 of an offset printing press, the dampening unit 1 being formed basically of a dampening-solution applicator roller 2, a metering roller 3 and a channel or duct 4 formed by outer cylindrical surfaces of the dampening-solution applicator roller 2 and the metering roller 3 and being filled during operation with dampening solution. The channel 4 is sealed at its two ends by means of a respective sealing device 5. Only one end of the channel 4 is shown in FIG. 2. More specifically, the metering roller 3 and the dampening-solution applicator roller 2 are individually disposed so that, in the contact zone, in which the rollers roll on one another, the respective circumferential speeds are basically directed downwardly.

A dampening-solution supply container 6 is disposed under the metering roller 3 and the dampening-solution applicator roller 2, respectively, and extends to a location under the channel 4.

Figure 3:
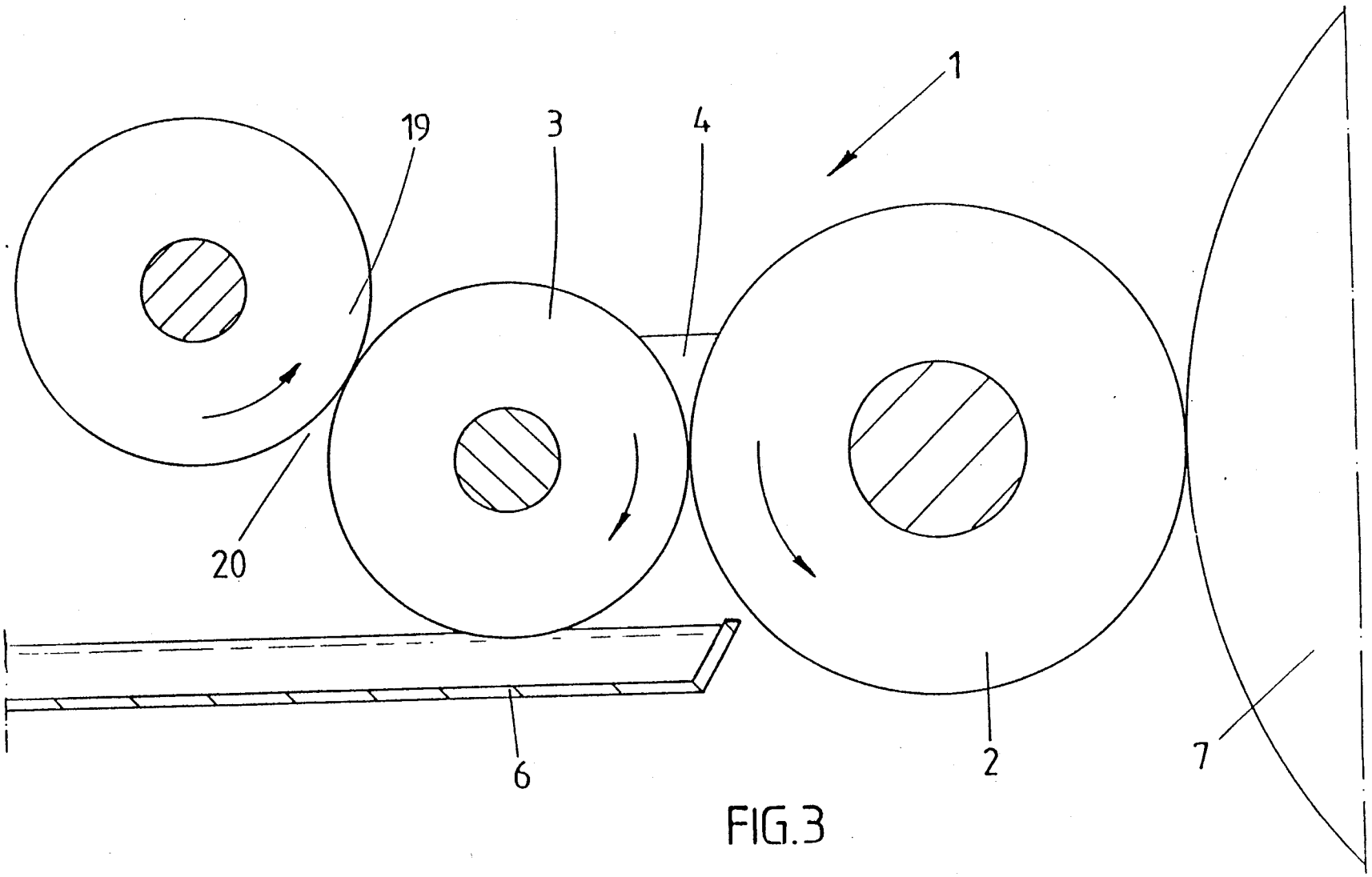
FIG. 3 is a view like that of FIG. 1 of an alternative construction of the dampening unit.

A plate cylinder 7 is dampened by means of the dampening-solution applicator roller 2, as is indicated diagrammatically, for example, in FIG. 3.

The sealing device 5 includes a seal holder 8 and a sealing element 9. The sealing element 9 has a side thereof facing away from the channel 4 which is in contact with the seal holder 8. The seal holder 8 has a holder limiter 14 for fixing the installation position of the sealing element 9. The seal holder 8 is disposed so that it can swivel about a pin 10. In the installation position shown, the seal holder 8 is secured against removal by means of a horizontally movable securing strap 11. Due to the directions of rotation (indicated by the associated arrows) of the dampening-solution applicator roller 2 and of the metering roller 3, and due to the contact pressure of the sealing element 9 against an end face of the dampening-solution applicator roller 2, the sealing element 9 and, with it, also the seal holder 8 are automatically drawn into the sealing position. It is provided, however, given a stoppage or special operating conditions of the printing press, for a roller (the dampening-solution applicator roller 2) to rotate slightly in reverse because of expansion of its elastic jacket or even for the directions of rotation of the rollers to change. In this connection, the securing strap 11 forms a non-reversing lock for the seal holder 8.

When the dampening unit 1 is in normal operation, the sealing element 9 is centered with respect to the geometrical axis 13 of the metering roller 3 by means of the holder limiter 14 and is preloaded by friction contact against an end face of the dampening-solution applicator roller 2.

The sealing element 9 has an overflow opening 15, which is connected to a drain passage 16. Excess dampening solution, conveyed from the metering roller 3 into the channel 4, is returned through the overflow opening 15 and the drain passage 16 into the dampening-solution supply container 6.

More specifically, as is readily apparent from FIG. 2, the drain passage 16 is formed by the surface 8' of the seal holder 8 and by a cutout 17 in the sealing element 9, the cutout 17 leaving lateral limiters 16'. The cutout 17 is in the form of a circular segment, preferably so that a midpoint thereof is on the geometrical axis 13 of the metering roller 3. After leaving the drain passage 16, the dampening solution is directed farther by a lower projection 18, extending at an angle downwardly with a slight inclination, as is indicated more specifically in FIG. 1 and 2.

The drain passage 16 and the cutout 17, respectively, in the sealing element 9 also continue above the overflow opening 15 in the form of a section 16''. An opening to the surroundings is formed, as is especially apparent from FIG. 2, in order to permit air compensation or equalization.

Although not shown in detail, the dampening-solution supply container 6 can extend laterally to beneath the drain passage 16, while it extends, besides, to beneath the channel 4, as is apparent from the drawing.

It is further apparent from FIG. 1, that the metering roller 3 has a further roller 19 assigned thereto which is arranged as a drawing roller in the illustrated embodiment. A lower region of the further roller 19 is immersed in the dampening-solution supply container 6. Another channel 20 opening downwardly, in this case, is formed between the further roller 19 and the metering roller 3 and, under certain conditions, excess dampening solution can accumulate therein. It is advantageous that even for a rapidly revolving drawing roller 19, dampening solution which has been sprayed off or splattered somewhat radially is immediately recaptured in the dampening-solution supply container 6. An effective protection against spraying upwardly is provided.

FIG. 3 illustrates diagrammatically another alternative arrangement of the further roller 19. The metering roller 3 is thus arranged as the drawing roller. The further roller 19 does not dip into the dampening solution of the supply container 6 in the construction of FIG. 3. In this arrangement, the further roller 19 acts as a spray guard.

For optimum distribution of the dampening solution, provision is preferably made for the further roller 19 to be movable oscillatingly.

With regard to the seal holder 8, it is further apparent more specifically from FIG. 1 that a side part 23 of the dampening unit is provided with a securing strap 11, which covers a front region of the seal holder 8 assigned to the dampening-solution applicator roller 2, in the as-installed position thereof, and thus prevents an undesired outward swing of the seal holder 8 out of the dampening unit. The seal holder 8 is further provided with a handle portion 21 which, with respect to the plane of the drawing of FIG. 1, is formed by being rearwardly bevelled or centered. The handle portion 21 partly overlaps the securing strap 11, which covers the seal holder 8.

The foregoing is a description corresponding in substance to German Application P 39 14 648.0, dated May 3, 1989, the International priority of which is being claimed for the instant application, and which is hereby made part of this application. Any material discrepancies between the foregoing specification and the aforementioned corresponding German application are to be resolved in favor of the latter.

We claim:

1. In a dampening unit on an offset printing press having a dampening-solution supply, and a dampening-solution applicator roller and a metering roller rolling on one another and defining therebetween a channel for receiving therein dampening solution from the dampening-solution supply, the dampening unit having a side part located at one end of the applicator roller and the metering roller a sealing device comprising a seal holder mounted on the side part, and a sealing element formed with one side in contact engagement with said seal holder and with another side opposite from said one side closing off an end of the channel, said sealing element being formed with an overflow opening for excess dampening solution, said sealing element being formed on said one side thereof with an elongated cutout covered by said seal holder so as to form a drain passage communicating with said overflow opening, said drain passage being open at an end thereof overlying the dampening-solution supply so as to provide means for delivering the excess dampening solution to the dampening solution supply.

2. Sealing device according to claim 1, wherein said drain passage extends above the overflow opening and comprises means for permitting an equalization of air.

3. Sealing device according to claim 1, including an additional roller rolling on the metering roller and disposed on a side of the metering roller opposite from the dampening-solution applicator roller.

4. Sealing device according to claim 3, wherein said additional roller is a drawing roller, and said dampening-solution supply is in a container in which said drawing roller is immersed.

5. Sealing device according to claim 1, including a securing strap disposed on a side part of the dampening unit and overlapping the seal holder when the latter is in installed condition.

6. Sealing device according to claim 5, including a handle portion formed on the seal holder, said handle portion partly covering said securing strap.

* * * * *

UNITED STATES PATENT AND TRADEMARK OFFICE

CERTIFICATE OF CORRECTION

PATENT NO. : 5,182,989

DATED : February 2, 1993

INVENTOR(S) : Walter D'Heureuse, et al

It is certified that error appears in the above-indentified patent and that said Letters Patent is hereby corrected as shown below:

On the Title Page, Item [73]:

"Heidelberg Druckmaschinen AG" should read --Heidelberger Druckmaschinen AG--.

Signed and Sealed this

Nineteenth Day of April, 1994

*Attest:*

*Attesting Officer*

BRUCE LEHMAN

*Commissioner of Patents and Trademarks*